US007048226B2

(12) United States Patent
Ridgeway, Jr. et al.

(10) Patent No.: US 7,048,226 B2
(45) Date of Patent: May 23, 2006

(54) PACKAGING REEL AND METHOD

(75) Inventors: Lawrence M. Ridgeway, Jr., Florence, SC (US); James M. Lee, Florence, SC (US)

(73) Assignee: American Spool and Packaging, Inc., Hartsville, SC (US)

( * ) Notice: Subject to any disclaimer, the term of this patent is extended or adjusted under 35 U.S.C. 154(b) by 117 days.

(21) Appl. No.: 10/447,807

(22) Filed: May 29, 2003

(65) Prior Publication Data

US 2005/0001087 A1 Jan. 6, 2005

Related U.S. Application Data

(63) Continuation-in-part of application No. 10/042,687, filed on Aug. 21, 2001, which is a continuation of application No. 09/383,908, filed on Aug. 26, 1999, now Pat. No. 6,341,745.

(51) Int. Cl.
*B65H 75/14* (2006.01)

(52) U.S. Cl. ..... 242/608.8; 242/610.4

(58) Field of Classification Search ..... 242/608.8, 242/610.4, 610.6, 118.32, 118.7; 264/46.5, 264/46.6, 46.9, 261, 262, 267
See application file for complete search history.

(56) References Cited

U.S. PATENT DOCUMENTS

| | | | |
|---|---|---|---|
| 3,179,245 | A | 4/1965 | Bastlan |
| 3,322,373 | A | 5/1967 | Wilson et al. |
| 3,454,235 | A | 7/1969 | Hurley |
| 3,460,246 | A | 8/1969 | Hatton |
| 3,491,171 | A | 1/1970 | French |
| 3,592,406 | A | 7/1971 | Martin et al. |
| 3,621,698 | A | 11/1971 | Rocco et al. |
| 4,186,162 | A | 1/1980 | Daley |
| 4,415,513 | A | 11/1983 | Plachy |
| 4,455,274 | A | 6/1984 | Horney |
| 5,229,048 | A | 7/1993 | Nelson |
| 5,535,961 | A | 7/1996 | Duckworth et al. |
| 5,660,900 | A | 8/1997 | Andersen et al. |
| 5,660,901 | A | 8/1997 | Wong |
| 5,721,031 | A | 2/1998 | Echigo et al. |

*Primary Examiner*—John Q. Nguyen
(74) *Attorney, Agent, or Firm*—B. Craig Killough

(57) ABSTRACT

A reel or spool package has opposing sidewalls or flanges formed of the specified or appropriate substrate. A core is positioned between the sidewalls. An insert is positioned into a center aperture of the core. A flowable adhesive material may be injected through an aperture in the sidewall and into a chamber that is formed between the insert, the core and the sidewall. The material sets and bonds the core and the sidewall to form the package.

19 Claims, 4 Drawing Sheets

PACKAGING REEL AND METHOD

This Application is a continuation in part of application Ser. No. 10/042,687 filed Aug. 21, 2001, which is a continuation of application Ser. No. 09/383,908, filed Aug. 26, 1999, U.S. Pat. No. 6,341,745 B1.

FIELD OF THE INVENTION

This invention relates to packaging materials generally, and is more specifically related to reels or spools for packaging.

BACKGROUND OF THE INVENTION

Reel packages and spool packages are used for the packaging of products which are produced in a continuous and connected manner and are packaged in large number or high count continuous lengths for long run use, including automated use. These products are typically packaged in a "ribbon wound" (layer on layer) or convolute manner on a central core of a size closely matching the width of the manufactured product, so that the user of the product may unwind the product in an orderly, controlled manner for use or installation in other products.

Products having a narrow face width may be wound so as to traverse the center core, alternately reversing direction within the confines of the sidewalls. The resulting package has multiple layers of product wound over the core, and between the sidewalls. Long, unbroken lengths of product may be packaged and stored by use of the elongated core with product that is traverse wound. Reels or spools that are useful with this type of packaging may have cores that are relatively long, and/or of relatively large diameter.

Products which are packaged on reels and spools are made of a wide variety of raw materials including metals, plastics, textiles and other products. The stiffness of some continuous products is such that the package must have a core with a large circumference (6 to 20") to prevent undesired curling or bending of the manufactured product. Additionally, packages for these products have sidewalls or flanges which act as retainers to keep the product from slipping off and becoming twisted, bent, damaged or difficult or impossible to use. The sidewalls for larger reels used for relatively rigid products range in size from 10" to 48", and are made of corrugated board, solid fibreboard, Masonite, plastic, plywood, or other suitable materials. While there are technical differences between spools and reels as these terms are used in the art, the term "reel" is used herein to indicate reels and spools used for packaging.

The cores of prior art reels are made of a number of substrates such as pre-formed and pre-cut styrofoam discs, or pressed wood, plywood discs, or other suitable materials. Another embodiment employs rings of paper tubing cut from pre-made large diameter spiral or convolute paper tubes of a size or width which very nearly matches the width of the product being packaged or in the case of traverse wound products, a size which allows for appropriate winding area considering the weight and volume of the package. The sidewalls or flanges are then attached or fastened in a manner which protects the product from external damage, confines the product to minimal sidewise movement, and keeps the product wound in a controlled convolute or traversed package, thereby allowing for orderly unwinding of the product by the user.

The methods employed in the prior art for joining sidewalls or flanges to cores are varied. Since some of the cores are discs with solid sides (such as styrofoam or pressed wood), adhesives are applied to these sides and the sidewalls of paper and corrugated board are brought into contact and unitized by the curing of the adhesive.

Other packages are of such large diameter that factors such as weight and cost make solid cores impractical. In such cases, cores are formed of paper rings of appropriate diameter and face width (matching the product to be convolutedly or traverse wound) which are centered on sidewalls with holes punched to accept flat head threaded bolts or rods of a length appropriate to the width of the reel (with allowance for the thickness of the sidewall substrates). The bolt holes are positioned in close proximity to the rings, so that when they are tightened, they eliminate, or minimize, rotation of the ring. The second sidewall is positioned, and bolts are pressed through both sidewalls, and capped head or "T" nuts are attached to the bolts and tightened, creating a circular package or reel customized to the product's winding method and load area. The load area is the area from the ring or core to the outside diameter of the flange or sidewall is the load area.

The use of such bolts or rods produces a strong package. However, these packages are relatively expensive due to the cost of the bolts or rods, and due to the assembly time and labor required.

The sidewalls or flanges often have punches or apertures for different functions positioned on its face such as:

1. A center or arbor hole for mounting on an axis or rod for smooth "take up" or "let off" of the continuous product.
2. A drive hole to accept a pin which will, when a rotational force is applied, turn the package and thereby wind or "take up" the product as it is produced. (This arbor and drive hole configuration has become largely standardized and has a fixed central location)
3. Small apertures for inspection, product access and handling, which have no meaningful structural significance.

SUMMARY OF THE INVENTION

The present invention is an improvement of reel or spool packages. The package of the present invention comprises opposing sidewalls or flanges formed of the appropriate material. A core is positioned between the sidewalls. An insert is positioned into a center aperture of the core. A flowable adhesive material is injected through an aperture in the sidewall and into a chamber that is a formed between the insert, the core and the sidewall. The flowable material, upon setting, connects the sidewalls and core to form the package. The resulting package is extremely strong, and will replace most applications that incorporate packages reinforced by the use of bolts or rods.

DESCRIPTION OF THE PREFERRED EMBODIMENTS

Figure 1:
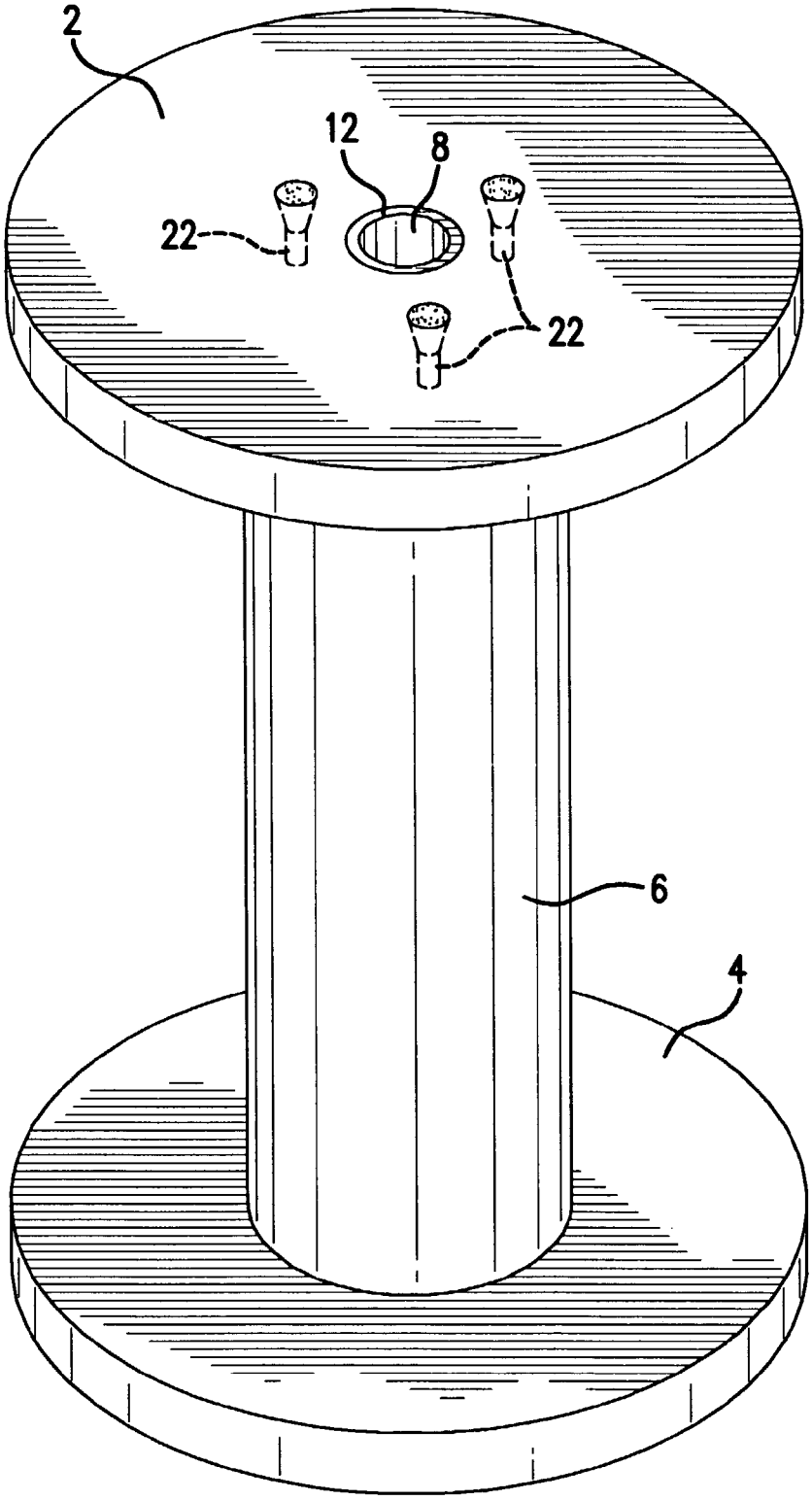
FIG. 1 is a perspective view of the improved reel for packaging

It may not be desirable to form, or fill, the length of an elongated core with polyurethane. In one embodiment of the invention, the reel package of the present invention comprises opposing sidewalls 2, 4 or flanges formed of the specified or appropriate substrate. FIG. 1. The sidewalls are typically circular, and formed to an appropriate thickness. The sidewalls may be formed of wood, paper, cardboard, STYROFOAM, or other materials used to form sidewalls for reels.

A core 6 is present between the sidewalls. The core may be elongated, hollow and cylindrical, or tubular. The core is positioned to be concentric with the sidewalls. The core may be formed of wood, paper or plastic, or other suitable material.

Figure 2:
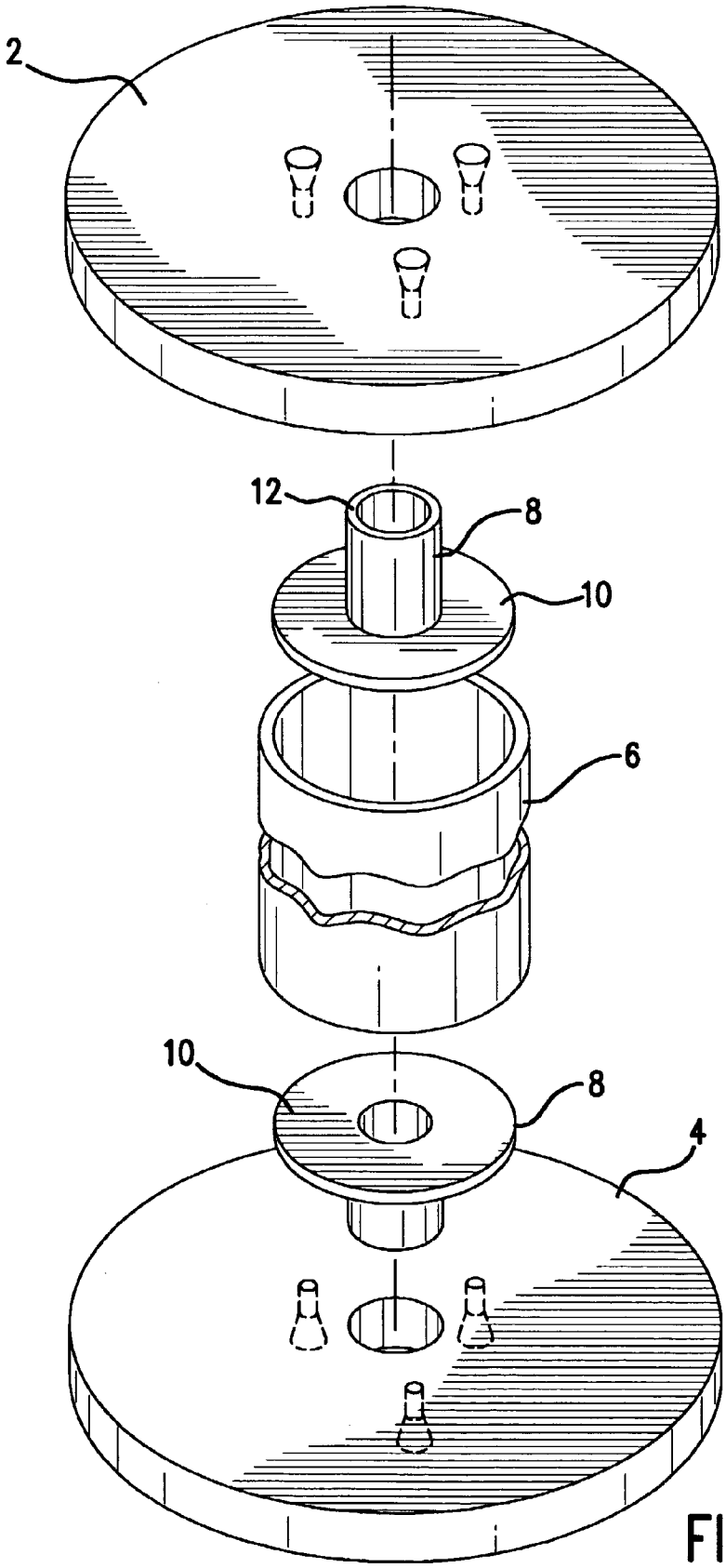
FIG. 2 is an exploded view of the improved reel for packaging.
Figure 3A:
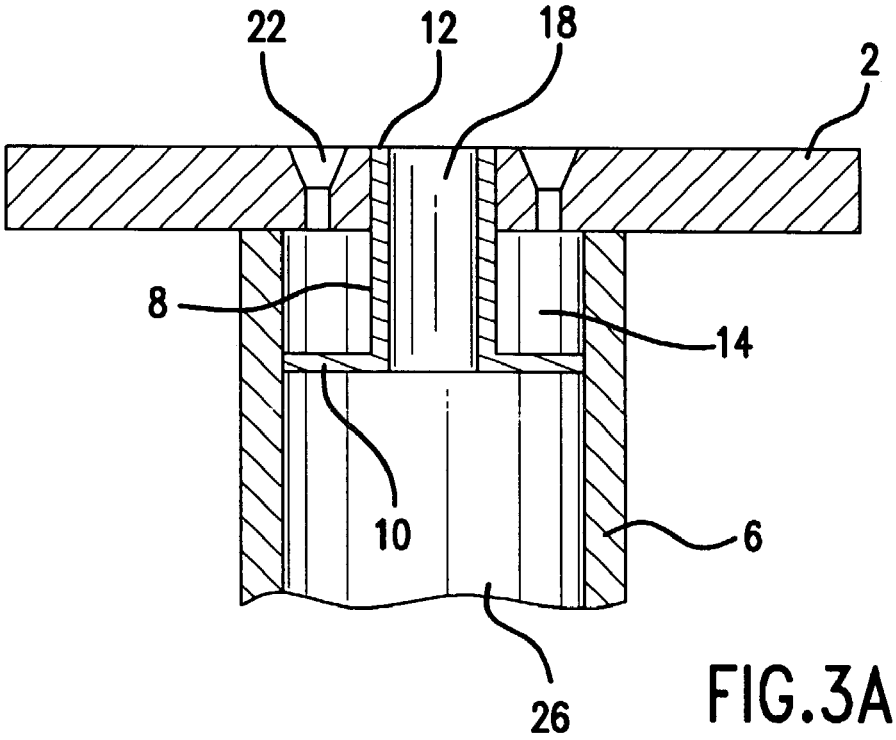
FIG. 3A is a sectioned view of the improved reel for packaging.

A pair of inserts 8 are present within the core, and at opposite ends of the core, as shown in FIG. 2. The inserts are positioned into a center aperture of the core, with an end 10 of the insert engaging the center aperture of the core. The opposite end 12 of the insert abuts the outside surface of the sidewalls 2, 4, or the insert extends through a center aperture that is formed in the sidewall. FIG. 3A. A chamber is formed and is present 14 between the insert, the core and the sidewall. The chamber creates a cavity that accepts the injection of the flowable adhesive material. The chamber may be an expansion chamber, that permits the expansion of the flowable material.

The first end 10 is of a diameter that allows the insert to be received by the center aperture of the core. The first end should be of sufficient diameter so that there is no material gap between the core and the first end that will permit a large amount of flowable material to be transported out of the expansion chamber. In a typical embodiment, the core will have a circular cross section, and the first end will also be circular, and is preferred to have a void therein. Other geometric configurations of the chamber(s) or void(s) may be incorporated to accommodate specific user requirements.

The second end 12 of the insert is smaller than the first end. The second end concentrically engages an aperture in the sidewall or flange 2 when the insert is fully inserted into the core, and positions the sidewall relative to the core. Alternatively, the second end of the insert may abut the end of the sidewall.

A center trunk 18 connects the first end and the second end. The center trunk may be hollow as shown, with a center aperture traversing he center trunk from the first end of the insert to the second end of the insert. The use of a hollow center trunk reduces the amount of flowable material that is required, which reduces the cost of the reel, and also reduces the weight of the package. As will be important in some applications, the center trunk allows an axle 20 to traverse the center of the reel, since such axles are used to wind and unwind the product relative to the reel.

Figure 3B:
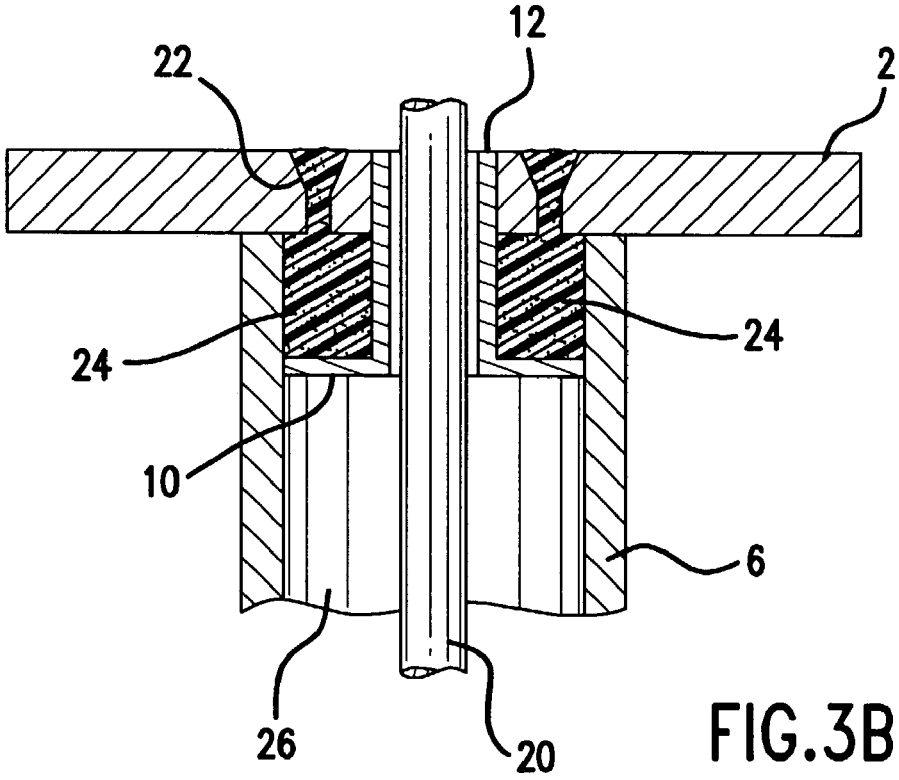
FIG. 3B is a sectioned view of the improved reel for packaging of FIG. 3A with flowable adhesive material present therein.

At least one aperture is formed in the insert for receiving the flowable material. As shown, three apertures 22 are present in the second end. One or more of the appropriately shaped apertures in the sidewalls allow for injection of the flowable material, and serve as an attachment feature that enhances bond strength of the sidewall to the core. The apertures may be conically shaped voids. The use of the inverse frusto-conically shaped voids as shown in FIG. 3B, after being filled with the flowable material, aid in holding the sidewall in place.

The flowable material is a liquid or semi-liquid material, which will harden or set to bond the components of the reel or spool. The flowable material acts as adhesive to connect the insert to the core. The second end of the insert holds the sidewall in place against the core, and the package is formed.

The flowable material is preferred to be comprised of two-part expandable polyurethane foam. Polyurethanes are formed by isocyanates, which are reacted with agents having a hydroxyl group, such as polyols. These materials may be produced as foam that expands as it is dispensed, and which sets after reaction of the components.

The foam 24 may be delivered through the apertures 22 into the expansion chamber 14. The expansion chamber is defined by the void formed between the insert, the inside diameter of the core and the portion of the sidewall that bounds the inside of the core. The foam is delivered in a metered dosage. The foam expands and fills the chamber, and the reaction of the components causes the foam to set and become solid in the shape of the chamber. The chemistry of the foam formulation may be altered to change density, rigidity and flexibility as required by package stresses. The expanded foam is a very aggressive and effective adhesive medium. As the foam cures, it adheres to each of the sidewalls, it performs the dual function of reinforcing the core and connecting the sidewalls and core to form the completed reel.

The use of an insert 8 on each end of the core 6 avoids filling the entire center of the core with flowable material, which reduces the cost of material and reduces filling time, while adding strength to the package. A hollow area 26 is present within the core and between the inserts. The length of the hollow area is dependent upon the overall length of the core.

Figure 4:
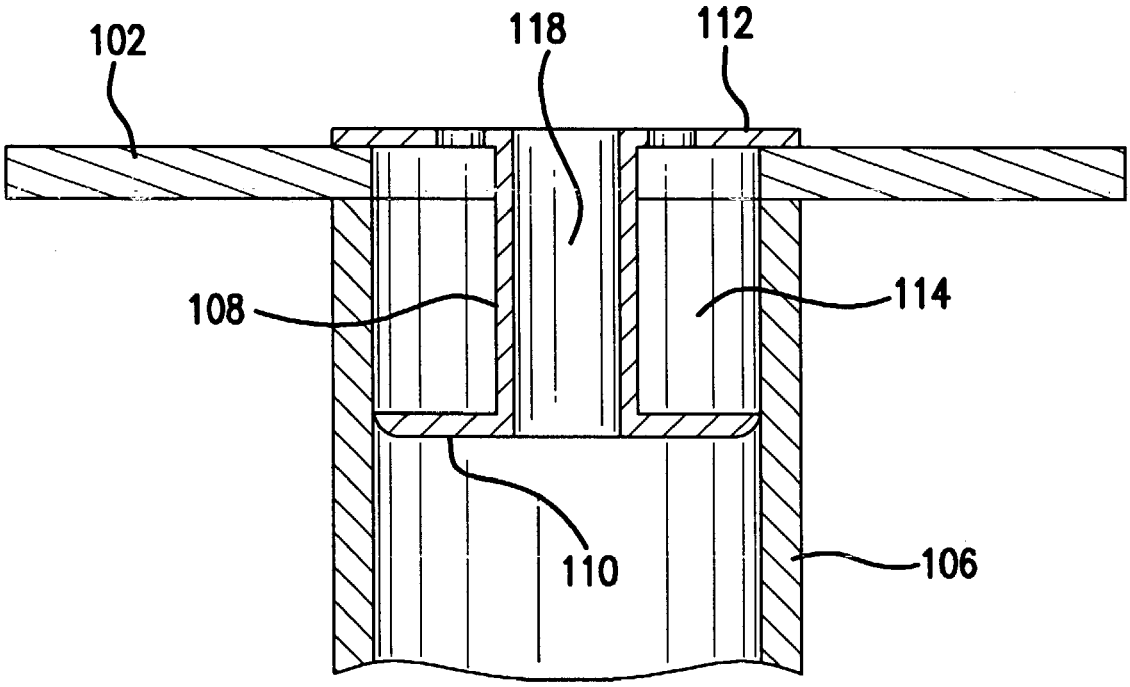
FIG. 4 is a sectioned view of another embodiment of the improved reel for packaging.

Another embodiment is shown in FIG. 4. The embodiments shown in the drawing figures are examples, and are not intended to limit the scope of the invention to those embodiments.

As with the embodiment discussed above, the reel package comprises opposing sidewalls 102 or flanges formed of the specified or appropriate substrate. FIG. 4. The sidewalls are typically circular, and of an appropriate thickness.

A core 106 is present between the sidewalls. The core is typically hollow and cylindrical, and is concentric with the sidewalls. The core may be made of paper or plastic, or other suitable material, as discussed above Inserts 108 are present within the core as shown. The insert is positioned into a center aperture of the core through a center aperture in the sidewall, with an end 110 of the insert engaging the center aperture of the core. The opposite end 112 of the insert abuts the outside surface of the sidewall 102. An expansion chamber is present 114 between the insert, the core and the sidewall.

The first end 110 of the insert has a diameter that allows the insert to be received by the center aperture of the core. The first end should be of sufficient diameter so that there is no material gap between the core and the first end. The use of a curved lip 116 around the perimeter of the first end facilitates insertion of the insert into the core, while retarding removal of the insert.

The second end 112 of the insert is larger than the first end. The second end abuts the sidewall when the insert is fully inserted into the core, holding the sidewall against the core.

A center trunk 118 connects the first end and the second end. The center trunk may be hollow as shown. The use of a hollow center trunk is as discussed above.

At least one aperture is formed in the insert for receiving the flowable material. The flowable material is applied to the expansion chamber as discussed above.

The invention works well with reel packages having diameters of 10 inches to 48 inches, and is particularly cost effective with regard to larger reels. Other applications of the process of the invention lend themselves to the dramatic cost savings in eliminating components and complexity of assembly. For example, plywood sided reels or spools that currently use the "Bolt-Thru" method of assembly may be formed by the method herein. The formulations achievable with the foam and the light wallpaper tubes to compartmentalize the application are very effective low cost replacements for the cores and assembly processes of the prior art, without changing the plywood used as the sidewall medium. The bond strength and variable density features are ideal for many heavy-duty applications.

Since the polyurethane foam is a highly effective bonding agent, plastic spools that require solvent bonding and complex tooling to impart strength and gain dimensional integrity are unnecessary. The use of simplified sidewalls bonded to a high strength core according to the present invention is an effective replacement. The elimination of harmful solvents is considered a benefit to the safety of the work place. The urethane foam is a safe bonding agent, and has an enviable record in industrial applications.

What is claimed is:

1. A reel around which a product is wound for transportation and storage, comprising:

a first sidewall;

a second sidewall;

a core, said core having a center aperture, and wherein said core extends between said first sidewall and said second sidewall;

an insert that is present within said center aperture of said core, wherein said insert forms a barrier within said center aperture of said core that is remote from said first sidewall, and wherein a chamber is formed that is between a portion of said center aperture of said core, a portion of said first sidewall that covers said center aperture of said core, and said insert, wherein said chamber is filled with a flowable material, and wherein said flowable material sets within said chamber and adheres to said first sidewall and to said core.

2. A reel around which a product is wound for transportation and storage as described in claim 1, wherein said first sidewall has at least one aperture therein that communicates with said chamber, and wherein said at least one aperture communicates with an exterior of said first sidewall.

3. A reel around which a product is wound for transportation and storage as described in claim 2, wherein at least a portion of said at least one aperture has a frusto-conical shape.

4. A reel around which a product is wound for transportation and storage as described in claim 1, wherein said insert has an annular lower end that is remote from said first sidewall and is within said center aperture of said core, and wherein said insert has a center trunk that extends from said annular lower end toward said first sidewall, and wherein said annular lower end of said insert forms said barrier.

5. A reel around which a product is wound for transportation and storage as described in claim 4 wherein said center trunk engages said first sidewall.

6. A reel around which a product is wound for transportation and storage as described in claim 1, wherein said insert has an annular lower end that is remote from said first sidewall and is within said center aperture of said core, and wherein said annular lower end has a void therein, and wherein said insert has a center trunk that extends from said annular lower end toward said first sidewall, and wherein said center trunk has a void therein that intersects said void in said annular lower end.

7. A reel around which a product is wound for transportation and storage as described in claim 6 wherein said center trunk engages said first sidewall.

8. A reel around which a product is wound for transportation and storage as described in claim 1, wherein a continuous void is formed which extends through said first sidewall, said core, said insert and said second sidewall, and wherein said continuous void does not intersect said chamber within said core.

9. A reel around which a product is wound for transportation and storage as described in claim 1, wherein said first sidewall is generally circular and is generally concentric with an insert, and wherein said outside perimeter of said first sidewall is generally circular.

10. A reel around which a product is wound for transportation and storage as described in claim 1, wherein said center aperture of said core further comprises a void that is not filled with said flowable material.

11. A reel around which a product is wound for transportation and storage as described in claim 1, wherein said flowable material is polyurethane foam.

12. A reel around which a product is wound for transportation and storage as described in claim 1, an second insert that is present within said core, wherein one end of said second insert is adjacent to said second sidewall, and wherein a second chamber is formed within said core that is defined by a portion of an inside of said core, by a portion of said second sidewall that covers said center aperture of said core, and by said second insert, wherein said second chamber is filled with a flowable material, and wherein said flowable material sets within said second chamber and adheres to said second sidewall and to said core.

13. A reel around which a product is wound for transportation and storage as described in claim 12, wherein said center aperture of said core further comprises a void that is not filled with said flowable material, and wherein said void that is not filled with said flowable material is present between said insert and said second insert.

14. A reel around which a product is wound for transportation and storage as described in claim 12, wherein a continuous void is formed which extends through said first sidewall, said core, said insert, said second insert and said second sidewall, and wherein said continuous void does not intersect either said chamber within said core or said second chamber within said core.

15. A reel around which a product is wound for transportation and storage as described in claim 1, wherein said first sidewall has at least one aperture formed therein that communicates with an exterior of said first sidewall and said chamber, and through which said flowable material is placed.

16. A reel around which a product is wound for transportation and storage as described in claim 1, wherein an entire perimeter of said first sidewall extends beyond an outside perimeter of said core.

17. A reel around which a product is wound for transportation and storage as described in claim 1, wherein one end of said insert is adjacent to said first sidewall.

18. A reel around which a product is wound for transportation and storage as described in claim 17, wherein said one end of said insert extends through an aperture that is present in said first sidewall.

19. A reel around which a product is wound for transportation and storage as described in claim 17, wherein said one end of said insert extends through said first sidewall and covers a portion of an exterior of said sidewall.

* * * * *